US008036561B2

(12) United States Patent
Pozniakas et al.

(10) Patent No.: US 8,036,561 B2
(45) Date of Patent: Oct. 11, 2011

(54) METHOD AND APPARATUS FOR CLEANING

(75) Inventors: Robert S. Pozniakas, Rochester, NY (US); Michael N. Soures, Webster, NY (US); Robert A. Gross, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 750 days.

(21) Appl. No.: 12/108,813

(22) Filed: Apr. 24, 2008

(65) Prior Publication Data

US 2009/0226203 A1 Sep. 10, 2009

Related U.S. Application Data

(60) Provisional application No. 61/035,239, filed on Mar. 10, 2008.

(51) Int. Cl.
*G03G 15/00* (2006.01)

(52) U.S. Cl. ..... 399/71; 399/343; 399/353

(58) Field of Classification Search ..... 399/71
See application file for complete search history.

(56) References Cited

U.S. PATENT DOCUMENTS 5,175,584 A * 12/1992 Usui ..... 399/44
5,546,177 A * 8/1996 Thayer ..... 399/353
5,740,495 A * 4/1998 Maher et al. ..... 399/71
2007/0147878 A1* 6/2007 Mori ..... 399/101

FOREIGN PATENT DOCUMENTS

JP 55163565 * 12/1980

* cited by examiner

*Primary Examiner* — David Gray
*Assistant Examiner* — Roy Y Yi
(74) *Attorney, Agent, or Firm* — Oliff & Berridge, PLC

(57) ABSTRACT

Aspects of the disclosure provided a method to improve performance of a cleaning device to extend a usage life of the cleaning device. The method can include obtaining a performance characteristic of an electrostatic brush that degrades operations of the electrostatic brush, determining at least one parameter that compensates for the degradation, and controlling the electrostatic brush by the at least one parameter to maintain the electrostatic brush operating within a failure boundary.

20 Claims, 6 Drawing Sheets

METHOD AND APPARATUS FOR CLEANING

This nonprovisional application claims the benefit of U.S. Provisional Application No. 61/035,239 "Cleaning Algorithms to Compensate for Aging & RH" filed on Mar. 10, 2008, which is incorporated herein by reference in its entirety.

BACKGROUND

Cleaning devices, such as an electrostatic brush, elastomeric blade, and the like, can be used in a printing system to remove particles, such as residue toner particles, on a photoreceptor surface. Performance of a cleaning device may degrade with usage and over time, which may leave a substantial amount of particles on the photoreceptor surface. Further, the substantial amount of particles on the photoreceptor surface may degrade printing quality. Therefore, a replacement cleaning device may be required to replace an old cleaning device after a certain usage of the old cleaning device to ensure quality printing. Frequent replacement of the cleaning devices may introduce additional maintenance cost and disturbance to a printing process.

SUMMARY

Aspects of the disclosure can provide a method to improve performance of a cleaning device to extend a usage life of the cleaning device. The method can include obtaining a performance characteristic of an electrostatic brush that degrades operations of the electrostatic brush, determining at least one parameter that compensates for the degradation, and controlling the electrostatic brush by the at least one parameter to maintain the electrostatic brush operating within a failure boundary.

Further, to obtain the performance characteristic of the electrostatic brush, the method can include monitoring a humidity of an environment. Additionally, the method can include monitoring a usage life of the electrostatic brush to obtain the performance characteristic. Specifically, the method can include counting a number of pages being printed as the usage life of the electrostatic brush.

According to an aspect of the disclosure, the at least one parameter can include at least one of a rotation speed, a biasing voltage and a pre-clean charging current. Therefore, the method can further include keeping a substantially constant number of fiber strikes as the electrostatic brush shrinks by increasing the rotation speed. Further, the method can include increasing the pre-clean charging current for a high humidity. Moreover, the method can include decreasing the biasing voltage for at least one of a new electrostatic brush and a high humidity.

Additionally, the method can include increasing the biasing voltage for an old electrostatic brush, and not exceeding a threshold biasing voltage to avoid a substantial leakage current.

Aspects of the disclosure can also provide an apparatus for cleaning. The apparatus can include an electrostatic brush configured to remove toner particles from a surface of a photoreceptor, a performance characteristic monitor configured to monitor a performance characteristic of the electrostatic brush that degrades operations of the electrostatic brush, and a controller coupled to the electrostatic brush and the performance characteristic monitor, the controller being configured to modify at least one parameter of the electrostatic brush according to the monitored performance characteristic to maintain the electrostatic brush operating within a failure boundary.

Additionally, aspects of the disclosure can provide a printing system. The printing system can include a photoreceptor configured to support toner particles to create a toner image on a surface of the photoreceptor, an electrostatic brush configured to remove residue toner particles from the surface of the photoreceptor, a performance characteristic monitor configured to monitor a performance characteristic of the electrostatic brush that degrades operations of the electrostatic brush, and a controller coupled to the electrostatic brush and the performance characteristic monitor, the controller being configured to modify at least one parameter of the electrostatic brush according to the monitored performance characteristic to maintain the electrostatic brush working within a failure boundary.

EMBODIMENTS

Figure 1:
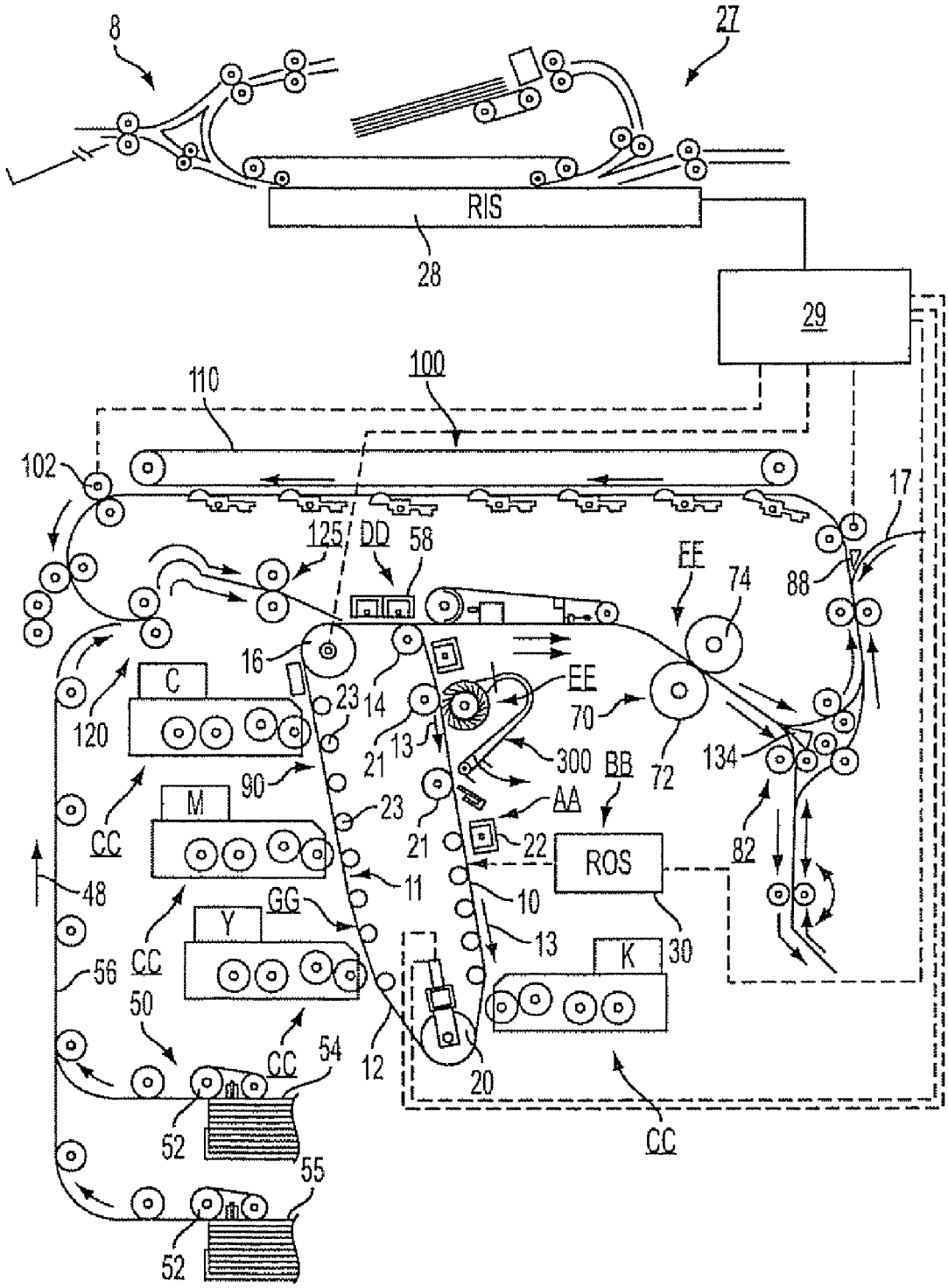
FIG. 1 shows a schematic elevational view of an exemplary printing system.

FIG. 1 shows a schematic elevational view of an exemplary printing system according to the disclosure. The printing system 100 can include various components, such as a photoreceptor device GG, a cleaning system EE, a charging system AA, an exposing system BB, a developing system CC, a transferring system DD, a fusing system FF, and the like, that support creating desired images. These elements can be coupled as shown in FIG. 1.

The photoreceptor device GG can be implemented in form of a photoreceptor belt with a coated layer of a photoconductive material. The photoreceptor device GG can move in a direction of arrow 13 to advance successively to other components of the printing system 100. It should be noted that the photoreceptor device GG can be implemented in other forms, such as a photoreceptor drum.

The cleaning system EE can include an electrostatic brush. The electrostatic brush can be utilized to remove particles, such as residue toner particles, from the surface of the photoreceptor device GG. The surface of the photoreceptor device GG can be required to be within a cleaning boundary after cleaning to ensure quality printing. Generally, the cleaning boundary can be defined as a number of remaining particles within a unit area. The cleaning system EE can be implemented according to the disclosure, such that the electrostatic brush can have an extended usage life. During the extended usage life, the electrostatic brush can still perform satisfactorily to keep the surface of the photoreceptor device GG within the cleaning boundary.

The charging system AA can prepare the surface of photoreceptor device GG with electrical charges for subsequent printing processes. More specifically, the charging system AA can produce electric fields, such as corona, to charge the surface of the photoreceptor device GG to a substantial uniform potential.

The exposing system BB can include a light emitting device, such as a semiconductor laser device, to emit a light beam having an intensity corresponding to a color density of a desired image. The light beam can pass through an optical system, and scan the surface of the photoreceptor device GG. Therefore, the electric potential of the photoreceptor device GG can be modified by the light beam to create an electrostatic latent image.

The developing system CC may include a plurality of developers, for example four developers K, Y, M, and C in FIG. 1. A developer can bring a developing material, such as toner particles, in contact with the electrostatic latent image on the surface of the photoreceptor device GG. The toner particles can be attracted to the surface of the photoreceptor device GG according to the electrostatic latent image to create a toner image.

The transferring system DD can then transfer the toner image from the surface of the photoreceptor device GG to a supporting sheet, such as a piece of paper. Further, the fusing system FF can permanently fuse the toner image on the supporting sheet.

During operation, for example, the surface of the photoreceptor device GG can turn to the cleaning system BE. The cleaning system EE can remove residue toner particles from a previous printing. Then, the surface of the photoreceptor device GG can move to the charging system AA. The charging system AA can charge the surface of the photoreceptor device GG to a substantially uniform potential. Subsequently, the surface of the photoreceptor device GG can move to the exposing system BB. The exposing system BB can dissipate the charges on the surface of the photoreceptor device GG according to a desired image to produce an electrostatic latent image.

Further, a developer of the developing system CC can apply toner particles to the surface of the photoreceptor device GG. The toner particles can adhere to the surface of the photoreceptor device GG according to the electrostatic latent image, thereby create a toner image. The toner image can then be transferred to a supporting sheet. However, some toner particles may be left on the surface of the photoreceptor device GG after transferring the toner image. Thus, the surface of the photoreceptor device GG can move to the cleaning system EE to have the surface cleaned to prepare for a next printing.

Figure 2:
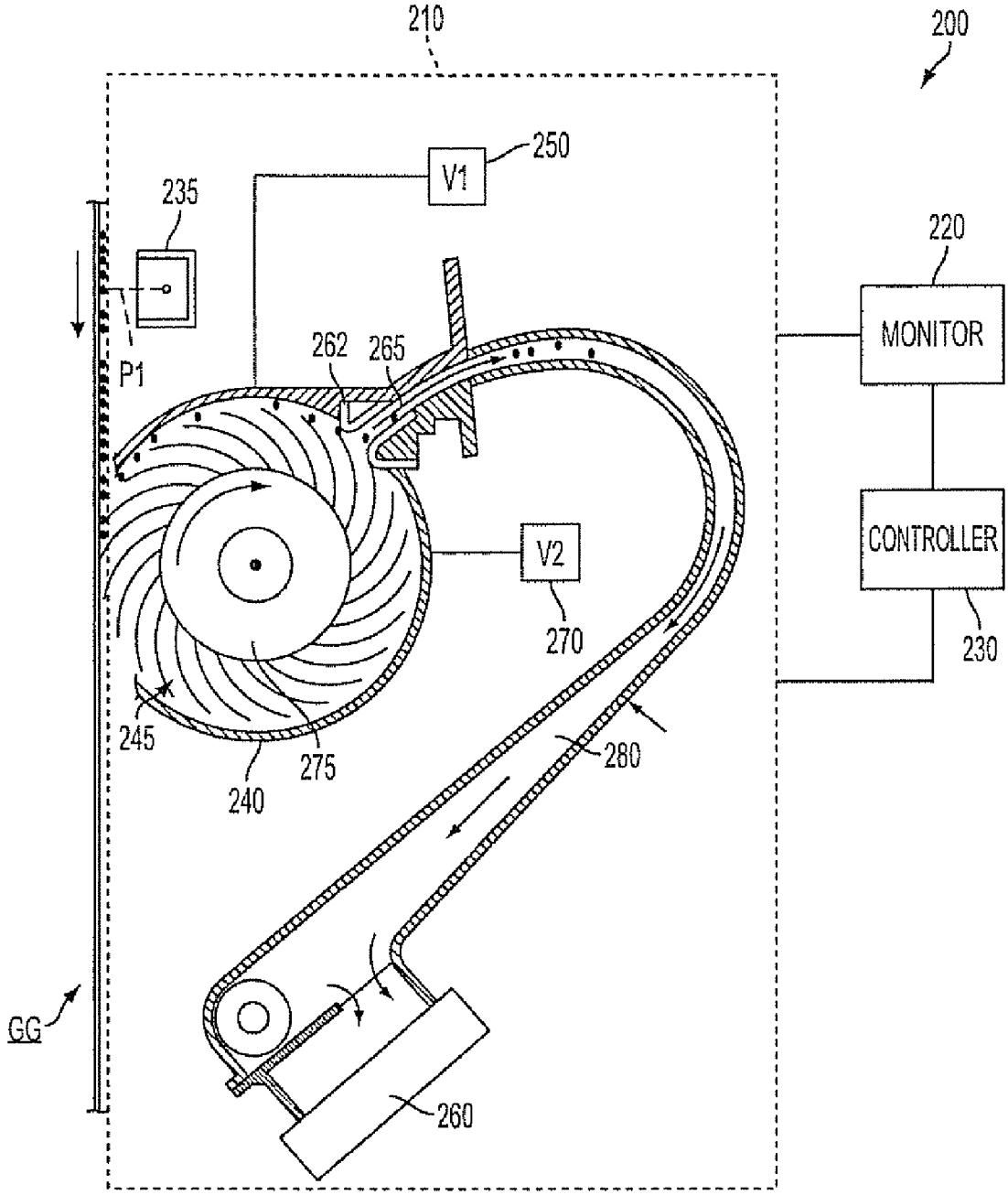
FIG. 2 shows a schematic of an exemplary cleaning system.

FIG. 2 shows a schematic of an exemplary cleaning system according to the disclosure. The cleaning system 200 can include a cleaning device 210, a monitor 220, and a controller 230 coupled as shown in FIG. 2. The cleaning device 210 can further include a pre-clean charging station 235, a housing 240, a surface scrubbing member, such as an electrostatic brush 245, mounted within the housing 240, an air blower 260, and a biasing source 250. These elements can be coupled as shown in FIG. 2.

The pre-clean charging station 235 can charge particles on the surface of the photoreceptor device GG to a predetermined polarity, such as a negative polarity. For example, the pre-clean charging station 235 may charge the particles with a negative pre-clean charging current. An amplitude of the pre-clean charging current can determine an electric potential of the charged particles. Subsequently, for example, the negative charged particles can be attracted and picked up by positively biased electrostatic brush via electric force.

The electrostatic brush 245 can rotate within the housing 240, and remove the particles on the surface of the photoreceptor device GG. While rotating, fibers of the electrostatic brush 245 can scrub the surface of the photoreceptor device GG. Higher rotation speed may be desired for good cleaning. However, higher rotation speed may have other adverse effects, such as increasing aging rate, generating defects, e.g., filming defects, and the like.

The biasing source 250 can bias the electrostatic brush 245 to a potential, such as a positive potential. Therefore, the positive biased brush fibers may attract the negative charged particles on the surface of the photoreceptor device GG by an electric force, and remove the negative charged particles from the photoreceptor device GG. A high biasing voltage may be desired for good cleaning.

However, the high biasing voltage may have other adverse effects. For example, the high biasing voltage can make a detoning process harder. The detoning process can refer to a process to remove the attracted particles from the electrostatic brush 245. Further, the high biasing voltage may increase re-deposition tendency. Re-deposition can refer to a phenomenon of particles returning from the electrostatic brush to the surface of the photoreceptor device GG. The high biasing voltage may create oppositely charged toner particles as a result of charge exchange of the toner particles with the electrostatic brush 245. The oppositely charged toner particles can have a tendency to re-deposit on the surface of the photoreceptor device GG. The re-deposition phenomenon can be a problem for a new electrostatic brush 245. In addition, the high biasing voltage may induce a large leakage current. For example, when the biasing voltage is larger than a threshold voltage, the leakage current can increase dramatically. The large leakage current may cause a power supply failure. In summary, various factors may need to be considered to determine an optimum biasing voltage.

The air blower 206 can direct an air stream, which can separate the attracted particles from the electrostatic brush 245, and flow the separated particles out of the housing 240. As can be seen, the rotating electrostatic brush 245 can bring attracted particles to an adjacent of an air path entry 265. At the entrance of the air path, a flicker bar 262 can remove or reduce charges on the particles to reduce an attraction force. In an embodiment, the flicker bar 262 may also dislodge the particles by mechanical forces. Further, an air stream force generated by the air blower 206 can separate the particles from the electrostatic brush 245. The separated particles may follow the air stream, and then can be collected by the air blower 260.

Additionally, a second biasing source 270 as shown in FIG. 2, can be used. For example, the second biasing source 270 can be a negative biasing source, which can repel the particles from the electrostatic brush 245. It should be understood that the biasing sources 250 and 270 can be AC biasing sources instead of DC biasing sources.

During operation, for example, the residue toner particles on the surface of the photoreceptor device GG can be charged by the pre-clean charging station 235 in order to enable a strong attraction of the charged particles to the electrostatic brush 245. For example, the residue toner particles can be negative charged by a negative charging current, while the electrostatic brush 245 can be biased positively. When the positive biased brush fibers scrub the surface of the photoreceptor device GG, the negative charged residue toner particles can be attracted to the brush fibers and picked up by the brush fibers. Subsequently, when the electrostatic brush 245 turned to the air path 265, the flick bar 262 can remove or reduce the charges on the particles. Further, the air stream created by the air blower 260 can separate the particles from the electrostatic brush 245. The particles can follow the air stream, and then be collected by the air blower 206.

Generally, a performance of the cleaning device 210 can depend on various parameters, such as a pre-clean charging current, a rotation speed, a biasing voltage, and the like. In addition, a performance characteristic of the cleaning device 210, such as a usage age of the electrostatic brush 245, a humidity of the environment, and the like, may also affect the performance.

According to the disclosure, the monitor 220 of the cleaning system 200 can monitor the performance characteristic of the cleaning device 210. In an embodiment, the monitor 220 may include a counter (not shown), the counter can count a number of pages have been printed since a replacement of the electrostatic brush 245. The number of pages can be used as a measure of the usage age for the electrostatic brush 245. In another embodiment, the monitor 220 may include a psychrometer (not shown) or a hygrometer (not shown) that can measure the humidity. Further, the monitor 220 can provide the monitored performance characteristic to the controller 230.

The controller 230 can receive the monitored performance characteristic, and determine a set of parameters for the cleaning device 210. The set of parameters can be used to control the cleaning device 210 to keep a satisfactory performance under the monitored performance characteristic. Therefore, the surface of the photoreceptor device GG after clean can be within the cleaning boundary. For example, when the electrostatic cleaning device 210 gets older, the performance of the cleaning device 210 may degrade. The controller 230 can adjust the set of parameters based on the usage age of the electrostatic brush 245 to compensate for the degradation due to the acing effect.

It should be understood that the controller 230 can be implemented as hardware, software, or a combination of hardware and software. In an embodiment, the controller 230 can be implemented as software algorithms stored in a memory, then a CPU can execute the software algorithms, and perform the above described functions.

As can be seen from the above description, the performance of the cleaning device 210 can be improved by adjusting the parameters, such as the pre-clean charging current, the biasing voltage, the rotation speed, and the like, to compensate for a degradation due to the performance characteristic of the cleaning device 210. More complexly, various other factors, such as the re-deposition phenomenon, the cleaning defects, the leakage current, the detoning process, and the like, may also need to be considered to determine the optimum parameters for controlling the cleaning device 210.

Figure 3:
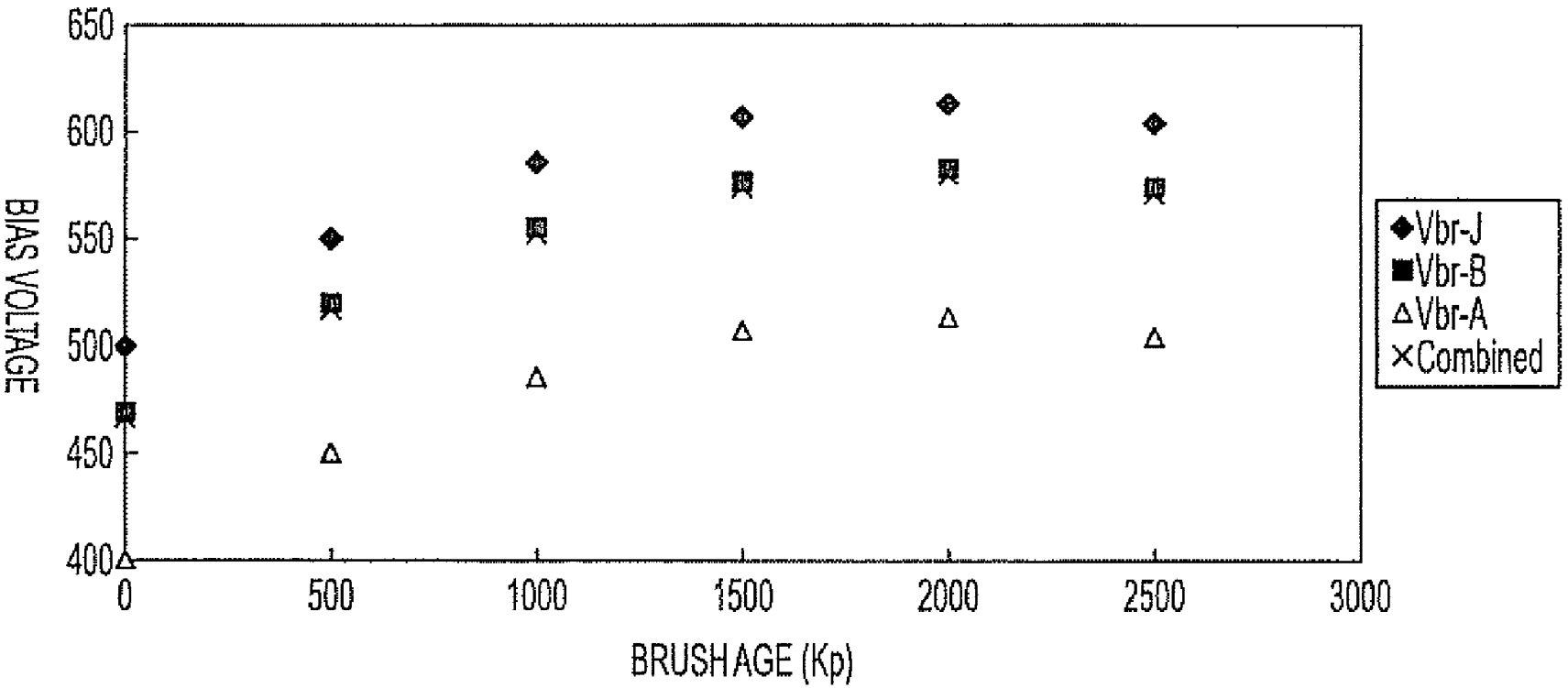
FIG. 3 shows an exemplary plot of optimum biasing voltages corresponding to various performance characteristics of a cleaning system.

FIG. 3 shows an exemplary plot of an optimum biasing voltage for a cleaning device tracked for various performance characteristics. The various performance characteristics can include a usage age of the cleaning device and a humidity of an environment. In FIG. 3, the usage age of the cleaning device can be tracked by X axis, the humidity can be tracked by various markers. More specifically, a low humidity, such as dry and cold, can be tracked by diamond markers; a medium humidity can be tracked by square markers; and a high humidity, such as warm and wet, can be tracked by triangle markers. Additionally, cross markers can be used to show an algorithm that determines the optimum biasing voltage for combined humidity categories.

As can be seen, when the cleaning device gets older, the optimum biasing voltage to keep a satisfactory cleaning performance can increase. Moreover, when the environment humidity decreases, the optimum biasing voltage to keep the satisfactory cleaning performance can also increase.

Various other factors can be considered in algorithms to determine the optimum biasing voltage. For example, a cleaning process may produce defects, such as filming, defects, on the surface of the photoreceptor device GG. A high biasing voltage can be good for reducing the filming defects. For another example, the biasing voltage may also affect the detoning process. A high biasing voltage can make it harder for the detoning process.

Another adverse factor to the high biasing voltage can be re-deposition phenomenon. The high biasing voltage can increase a re-deposition tendency. The re-deposition phenomenon can be a problem when the electrostatic brush 245 is new, and/or the humidity is high. Further, the high biasing voltage can increase a leakage current, which may cause a power supply failure. Therefore, various factors may need to be taken into account to determine the optimum biasing voltage. In an exemplary algorithm, when the electrostatic brush is new, the optimum biasing voltage can be set lower to avoid re-deposition. When the electrostatic brush is old, the optimum biasing voltage can be increased to improve the cleaning performance, therefore, a usage life of the electrostatic brush can be extended. Additionally, the exemplary algorithm may keep the optimum biasing voltage under a threshold voltage, such as 600V, to avoid a substantial leakage current.

Figure 4:
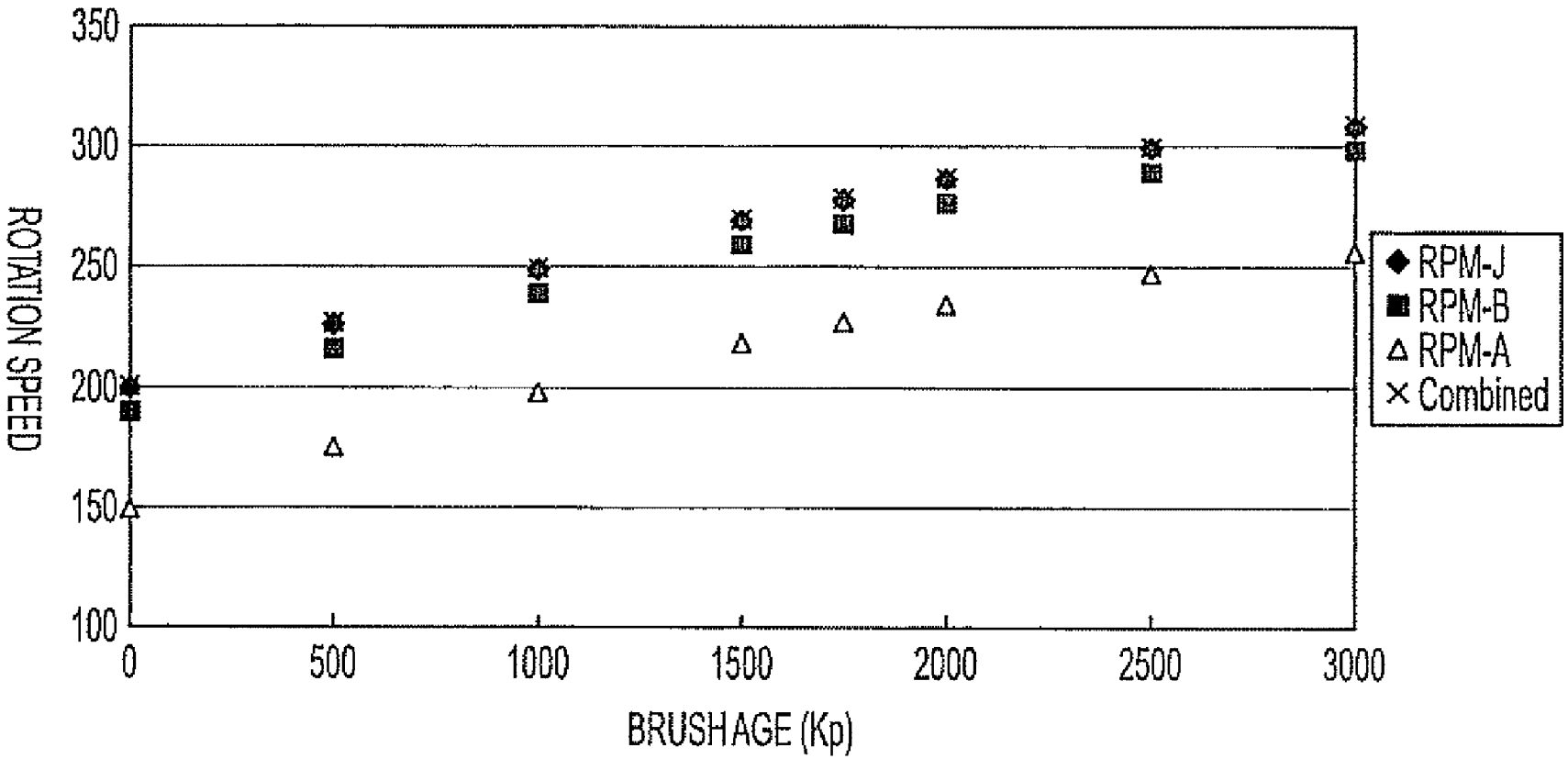
FIG. 4 shows an exemplary plot of optimum rotation speeds corresponding to various performance characteristics of a cleaning system.

FIG. 4 shows an exemplary plot of an optimum rotation speed for a cleaning device tracked for various performance characteristics. The various performance characteristics can include a usage age of the cleaning device and a humidity of the environment. In FIG. 4, the usage age of the cleaning device can be tracked by X axis, and the humidity can be tracked by various markers. More specifically, a low humidity, such as dry and cold, can be tracked by diamond markers; a medium humidity can be tracked by square markers; and a high humidity, such as warm and wet, can be tracked by triangle markers. Additionally, cross markers can be used to show an algorithm that determines the optimum rotation speed for combined humidity categories.

As can be seen, when the cleaning device gets older, the optimum rotation speed to keep the satisfactory cleaning performance can increase. Moreover, when the environment humidity decreases, the optimum rotation speed to keep the satisfactory cleaning performance can also increase.

Various other factors can be considered in the algorithm to determine the optimum rotation speed. For example, a high rotation speed may make an electrostatic brush 245 age faster. Further, the high rotation speed may generate more defects, such as filming defects. In an embodiment, a strategy can be implemented in an algorithm to determine the optimum rotation speed. The strategy can increase the optimum rotation speed to maintain a constant fiber strikes as the electrostatic brush 245 shrinks. However, the strategy may avoid exceeding a threshold rotation speed, such as 250 round per minute (rpm), before a threshold usage life of the electrostatic brush 245, such as 1,500 kilo-page (kp).

As described above, the parameters for controlling the performance of the cleaning device 210 can include the pre-clean charging current. Generally, a low pre-clean charging current can be desired for cleaning as long as the toner particles can be charged with a same polarity. However, oppositely charged toner particles can appear as a result of charge exchange between the electrostatic brush and the toner particles. The oppositely charged toner particles can re-deposit on the surface of the photoreceptor device GG. The re-deposition can be a problem for a new electrostatic brush 245. Further, the re-deposition can be worse when the humidity is high.

The re-deposition can be alleviated by a high pre-clean charging current. In an embodiment, a strategy can be implemented in an algorithm to determine an optimum pre-clean charging current. The strategy can adjust the pre-clean charging current to a higher level for a new electrostatic brush 245, or a high humidity environment. Alternatively, the strategy can also adjust the biasing voltage as described above to alleviate the re-deposition for the new electrostatic brush 245.

Figure 5:
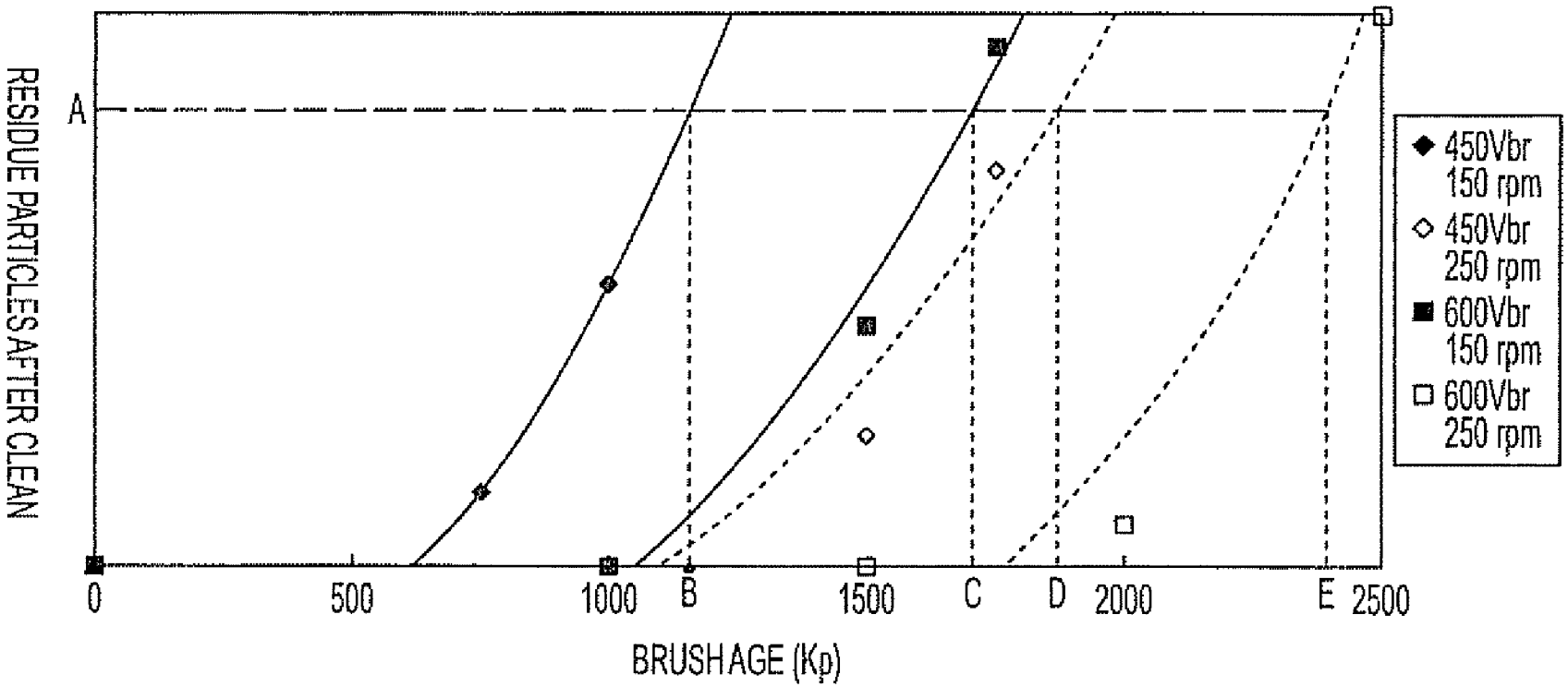
FIG. 5 shows an exemplary plot of brush performance changing with usage under various sets of parameters.

FIG. 5 shows an exemplary plot of a performance changing with a usage under various sets of parameters for an electrostatic brush. In FIG. 5, X axis can track a usage of the electrostatic brush, and Y axis can be a measure of performance of the electrostatic brush. For example, the Y axis can be a number of residue particles per unit area after clean. For another example, the Y axis can be a failure percentage, which is a percentage ratio of the number of residue particles after clean to a threshold number of residue particles corresponding to a performance failure.

As can be seen, four sets of parameters can be tracked in FIG. 5 by various markers. More specifically, dark diamond markers can track a set of a low biasing voltage and a low rotation speed; light diamond markers can track a set of a low biasing voltage and a high rotation speed; dark square markers can track a set of a high biasing voltage and a low rotation speed; and light square markers can track a set of a high biasing voltage and a high rotation speed.

As can be seen, when the usage of the electrostatic brush 245 gets larger, which means the electrostatic brush 245 is older, a larger number of particles can be left on the surface of the photoreceptor device GG. The performance of the electrostatic brush 245 can degrade. Further, among the four sets of parameters, the set of the high biasing voltage and the high rotation speed can control the cleaning device 210 to have a best performance, especially when the electrostatic brush 245 gets older. Therefore, adjusting the biasing voltage and the rotation speed may extend the electrostatic brush usage life. As shown in FIG. 5, for example, if A denotes a threshold for performance failure, B-E can denote the usage life of the electrostatic brush 245 for various sets of parameters. As can be seen, increasing the biasing voltage and the rotation speed can result in a longer usage life.

Figure 6:
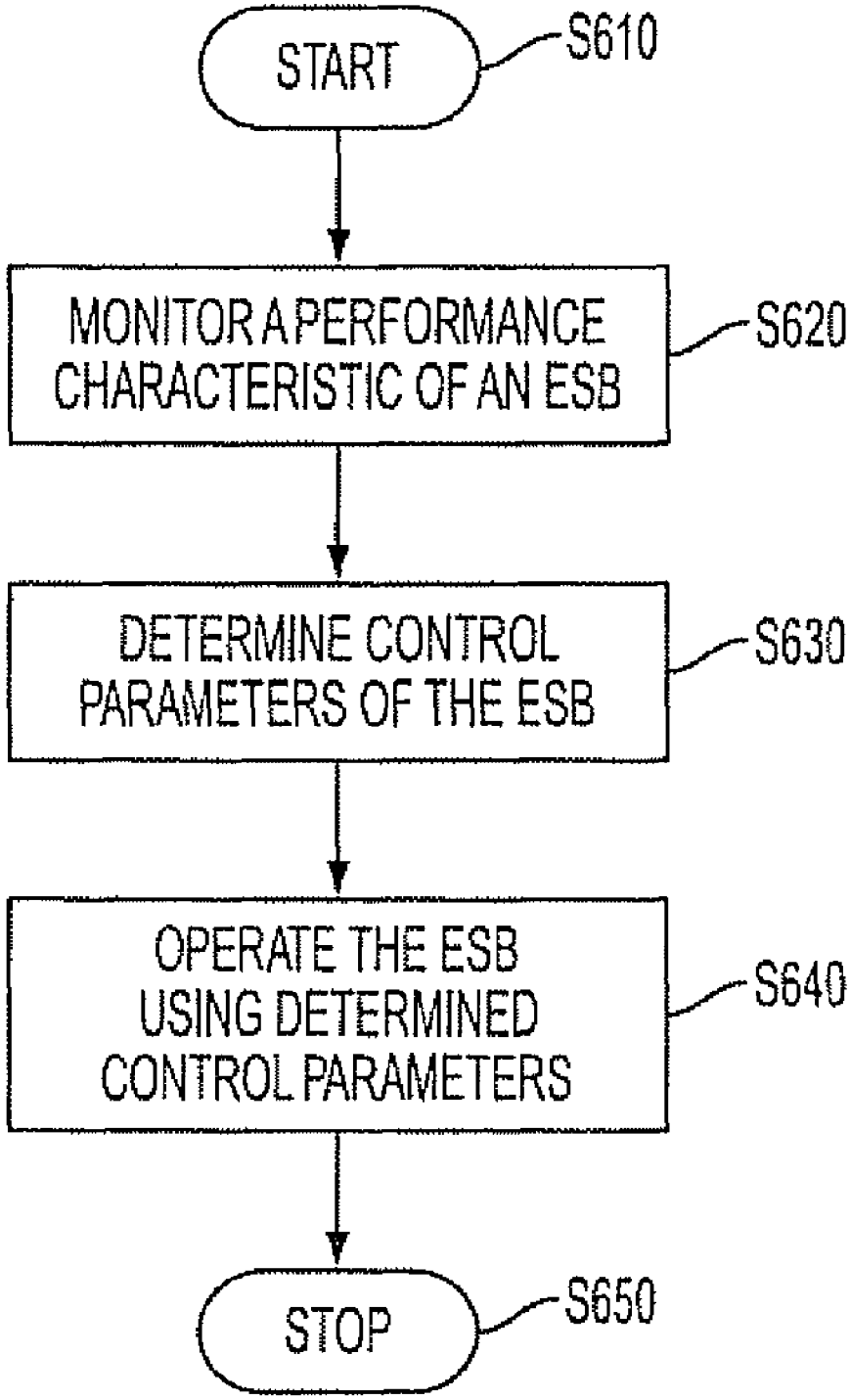
FIG. 6 shows a flowchart outlining an exemplary cleaning process.

FIG. 6 shows a flowchart outlining an exemplary cleaning process according to the disclosure. The cleaning process 600 starts at step S610, and proceeds to step S620. In step S620, the monitor 220 may monitor a performance characteristic of the cleaning device 210. For example, the monitor 220 may count a number of pages has been printed since a replacement of the electrostatic brush 245. For another example, the monitor 220 may measure a humidity of the environment. Further, the monitor 220 may inform the controller 230 of the performance characteristic. The process then proceeds to step S630.

In step S630, the controller 230 can determine a set of parameters, such as biasing voltage, pre-clean charging current, rotation speed, and the like. The set of parameters can be determined based on the performance characteristic of the clean device. In addition, other factors, such as detoning, filming, leakage, can be considered as well. Then the process proceeds to step S640.

In step S640, the set of parameters can be used to control the cleaning device 210. For example, when the electrostatic brush 245 gets older, the biasing voltage and the rotation speed can be increased to improve a cleaning performance of the cleaning device 210. Therefore, a usage life of the electrostatic brush 245 can be extended. The process then proceeds to step S650 and terminate.

It will be appreciated that various of the above-disclosed and other features and functions, or alternatives thereof, may be desirably combined into many other various systems or applications. Also, various presently unforeseen or unanticipated alternatives, modifications, variations or improvements therein may be subsequently made by those skilled in the art, and are also intended to be encompassed by the following claims.

What is claimed is:

1. A method for cleaning, comprising:

obtaining a performance characteristic of an electrostatic brush that degrades operations of the electrostatic brush;

determining at least one parameter that compensates for the degradation, the at least one parameter including a biasing voltage; and controlling the electrostatic brush by the at least one parameter to maintain the electrostatic brush operating within a failure boundary, wherein the biasing voltage is controlled such that it does not exceed a threshold biasing voltage to avoid a substantial leakage current, and the at least one parameter further includes at least one of a rotation speed and a pre-clean charging current.

2. The method according to claim 1, wherein obtaining the performance characteristic of the electrostatic brush further comprises:

monitoring a humidity of an environment.

3. The method according to claim 1, wherein obtaining the performance characteristic of the electrostatic brush further comprises:

monitoring a usage life of the electrostatic brush.

4. The method according to claim 3, wherein monitoring the usage life of the electrostatic brush, further comprises:

counting a number of pages being printed.

5. The method according to claim 1, wherein controlling the electrostatic brush by the at least one parameter further comprises:

keeping a substantially constant number of fiber strikes as the electrostatic brush shrinks by increasing the rotation speed.

6. The method according to claim 1, wherein controlling the electrostatic brush by the at least one parameter further comprises:

increasing the pre-clean charging current for a high humidity.

7. The method according to claim 1, wherein controlling the electrostatic brush by the at least one parameter further comprises:

decreasing the biasing voltage for a high humidity.

8. The method according to claim 1, wherein controlling the electrostatic brush by the at least one parameter further comprises:

increasing the biasing voltage for an old electrostatic brush.

9. An apparatus for cleaning, comprising:

an electrostatic brush configured to remove toner particles from a surface of a photoreceptor;

a performance characteristic monitor configured to monitor a performance characteristic of the electrostatic brush that degrades operations of the electrostatic brush; and a controller coupled to the electrostatic brush and the performance characteristic monitor, the controller being configured to modify at least one parameter of the electrostatic brush according to the monitored performance characteristic to maintain the electrostatic brush operating within a failure boundary, wherein the at least one parameter includes a biasing voltage, the biasing voltage is controlled such that it does not exceed a threshold biasing voltage to avoid a substantial leakage current, and the at least one parameter further includes at least one of a rotation speed and a pre-clean charging current.

10. The apparatus according to claim 9, wherein the performance characteristic monitor further comprises:

a hygrometer configured to measure a humidity of an environment.

11. The apparatus according to claim 9, wherein the performance characteristic monitor further comprises:

an element configured to monitor a usage life of the electrostatic brush.

12. The apparatus according to claim 11, wherein the element configured to monitor the usage life of the electrostatic brush, further comprises:

a counter configured to count a number of pages being printed.

13. The apparatus according to claim 9, wherein the controller is further configured to keep a substantially constant number of fiber strikes as the electrostatic brush shrinks by increasing the rotation speed.

14. The apparatus according to claim 9, wherein the controller is further configured to increase the pre-clean charging current for a high humidity.

15. The apparatus according to claim 9, wherein the controller is further configured to decrease the biasing voltage for a high humidity.

16. The apparatus according to claim 9, wherein the controller is further configured to increase the biasing voltage for an old electrostatic brush.

17. A non-transitory computer readable medium, wherein the non-transitory computer readable medium stores program instructions for configuring the controller of the apparatus according to claim 9.

18. A printing system, comprising:

a photoreceptor configured to support toner particles to create a toner image on a surface of the photoreceptor;

an electrostatic brush configured to remove residue toner particles from the surface of the photoreceptor;

a performance characteristic monitor configured to monitor a performance characteristic of the electrostatic brush that degrades operations of the electrostatic brush; and a controller coupled to the electrostatic brush and the performance characteristic monitor, the controller being configured to modify at least one parameter of the electrostatic brush according to the monitored performance characteristic to maintain the electrostatic brush working within a failure boundary, wherein the at least one parameter includes a biasing voltage, the biasing voltage is controlled such that it does not exceed a threshold biasing voltage to avoid a substantial leakage current, and the at least one parameter further includes at least one of a rotation speed and a pre-clean charging current.

19. The method according to claim 1, wherein controlling the electrostatic brush by the at least one parameter further comprises:

decreasing the biasing voltage for a new electrostatic brush.

20. The apparatus according to claim 9, wherein the controller is further configured to decrease the biasing voltage for a new electrostatic brush.

* * * * *